United States Patent [19]

Kimblin et al.

[11] 4,276,455

[45] Jun. 30, 1981

[54] VACUUM ENVELOPE FOR CURRENT LIMITER

[75] Inventors: Clive W. Kimblin; Paul G. Slade, both of Pittsburgh, Pa.

[73] Assignee: Electric Power Research Institute, Inc., Palo Alto, Calif.

[21] Appl. No.: 822,198

[22] Filed: Aug. 5, 1977

[51] Int. Cl.[3] ..... H01H 33/66

[52] U.S. Cl. ..... 200/144 B

[58] Field of Search ..... 200/144 B

[56] References Cited

U.S. PATENT DOCUMENTS

| | | | |
|---|---|---|---|
| 1,836,654 | 12/1931 | Dorn et al. | 200/144 B |
| 1,941,273 | 12/1933 | Prince | 200/144 B |
| 3,071,667 | 1/1963 | Lee | 200/144 B |
| 3,261,954 | 7/1966 | Yonkers | 200/144 B |
| 4,021,628 | 7/1977 | Kimblin | 200/144 B |

FOREIGN PATENT DOCUMENTS

| | | | |
|---|---|---|---|
| 767772 | 9/1967 | Canada | 200/144 B |
| 1258015 | 12/1971 | United Kingdom | 200/144 B |
| 223869 | 4/1968 | U.S.S.R. | 200/144 B |

*Primary Examiner*—Robert S. Macon

*Attorney, Agent, or Firm*—Flehr, Hohbach, Test et al.

[57] ABSTRACT

An improved envelope for a vacuum device circuit interrupter of the type having a pair of relatively movable electrodes within a vacuum envelope and including magnetic field arc suppression. The envelope includes end portions which support the electrodes and an intermediate insulating portion which surrounds and is spaced from the electrodes. Means for producing a magnetic field is outside the envelope. The insulating portion is of a shape which provides a greater distance between the electrodes and the surrounding insulating portion in the direction in which an interelectrode arc is deflected by the magnetic field. In the preferred embodiment the insulating portion is substantially cylindrical in shape with a pair of protruding side tubes. The interrupter envelope is oriented so the arc is deflected down the inside of the side tubes.

17 Claims, 3 Drawing Figures

VACUUM ENVELOPE FOR CURRENT LIMITER

BACKGROUND OF THE INVENTION

The invention relates to current interrupters of the vacuum-type for use in controlling fault currents associated with transmission lines in power distribution systems. In particular, the invention relates to the shape of the vacuum envelope employed in the current interrupter portion of a current limiting circuit.

Increases in electric power demand has led utility systems to use higher voltages in the transmission of power. Fault currents, due to ground shorts for example, can rapidly become enormous on high voltage power distribution lines and can cause serious equipment damage. Therefore, as transmission voltages rise, there is a continuing need in the electric power industry for improved current limiting devices capable of rapidly controlling fault currents.

Current limiters generally employ a current-suppressive impedance in parallel with some type of current interrupter. The interrupter opens under a fault condition and the current is diverted through the impedance, which limits the current to a safe level. A vacuum-type current interrupter generally comprises a pair of relatively movable electrodes in a vacuum envelope. The electrodes can be placed in electrical contact to provide a free path for current flow. Means are associated with the interrupter to separate the electrodes when a fault current is detected. When the electrodes separate, arcing occurs across the gap between the electrodes as soon as the last point of contact has been broken. Since the arc continues to carry substantially the full fault current it becomes necessary to extinguish the arc if the current is to be successfully diverted through the current-suppressive impedance.

In the past it has been possible in alternating current power systems to permit the interelectrode arc in an interrupter to burn until a normal current zero is reached, at which time the arc disappears. Reignition of the arc is prevented if the dielectric strength across the electrode gap is sufficient to withstand the subsequent transient voltages. In present high-voltage lines, fault currents can build up to such a high value that even a single current half-cycle can cause damage to the transmission system. Instead, it is necessary to immediately suppress the arc. One method of extinguishing the arc is by application of a transverse magnetic field across the interelectrode gap of the vacuum device. The magnetic field causes a space charge in front of the anode which in turn causes a large voltage drop across the interrupter. This high voltage can then be used to force the current into the parallel current-suppressive impedance.

Arcing which occurs in vacuum causes the release of a cloud of metallic vapor containing conductive ions of electrode material. This metallic vapor forms a metallic deposit upon any surface it reaches. After repeated interruptions, this deposit can build into a continuous current path which can seriously degrade interrupter performance. For example, if the arc is driven by the magnetic field into the wall of the envelope when it is coated with metallic arc deposit, an arcing path will likely arise from one electrode to the wall and then back to the other electrode. This can prevent arc extinction because the magnetic field cannot divert an arc carrying current in a direction parallel to the lines of magnetic force. A magnetic field creates a Hall electric field which diverts an arc in the J X B direction and, unless the arc cuts across the lines of magnetic force, there is no resultant diverting force. When arcing initiates between the electrodes and the envelope wall, the arc tends to align itself with the magnetic field lines. If this happens, the arc is unaffected by the magnetic field and will continue to burn. It is therefore highly undesirable to have arcing proceed between the electrodes and the envelope wall.

It is preferable to have the wall of the vacuum envelope spaced far from the electrodes so as to discourage arcing between the electrodes and the wall. Most commonly this is done by increasing the diameter of the envelope. This greatly increases the cost of the interrupter. It also necessitates larger separation between the exterior magnetic field coils used to suppress the arc. Interelectrode field strength is thereby lowered, resulting in reduced performance.

OBJECTS AND SUMMARY OF THE INVENTION

It is an object of the invention to provide a vacuum-type current interrupter employing magnetic arc suppression which has improved performance.

Another object of the invention is to provide such an interrupter in which the walls of the vacuum envelope in the regions toward which the arc is deflected are a large distance from the electrodes.

Accordingly, a current interrupter is provided for rapidly interrupting currents associated with power line faults having an evacuated envelope and a pair of relatively movable electrodes within the envelope. The evacuated envelope has spaced end portions and an intermediate insulating portion which is preferably substantially cylindrical in shape and sealed to the end portions. Each of the electrode members is supported within the envelope by one of the end portions of the envelope. The electrodes are relatively movable into and out of conductive contact. When separated under fault conditions, arcing occurs between the electrodes. Means is provided for producing a magnetic field between the electrodes when separated to deflect the arc toward the surrounding insulating portion to extinguish the arc. The insulating portion of the envelope is spaced from and surrounds the electrode members and is shaped so that the spacing between electrodes and the insulating portion is greatest in the region where the arc is deflected by the magnetic field. Thus the arcing distance between the electrodes and the surrounding insulating portion is increased.

DESCRIPTION OF THE PREFERRED EMBODIMENT

Figure 1:
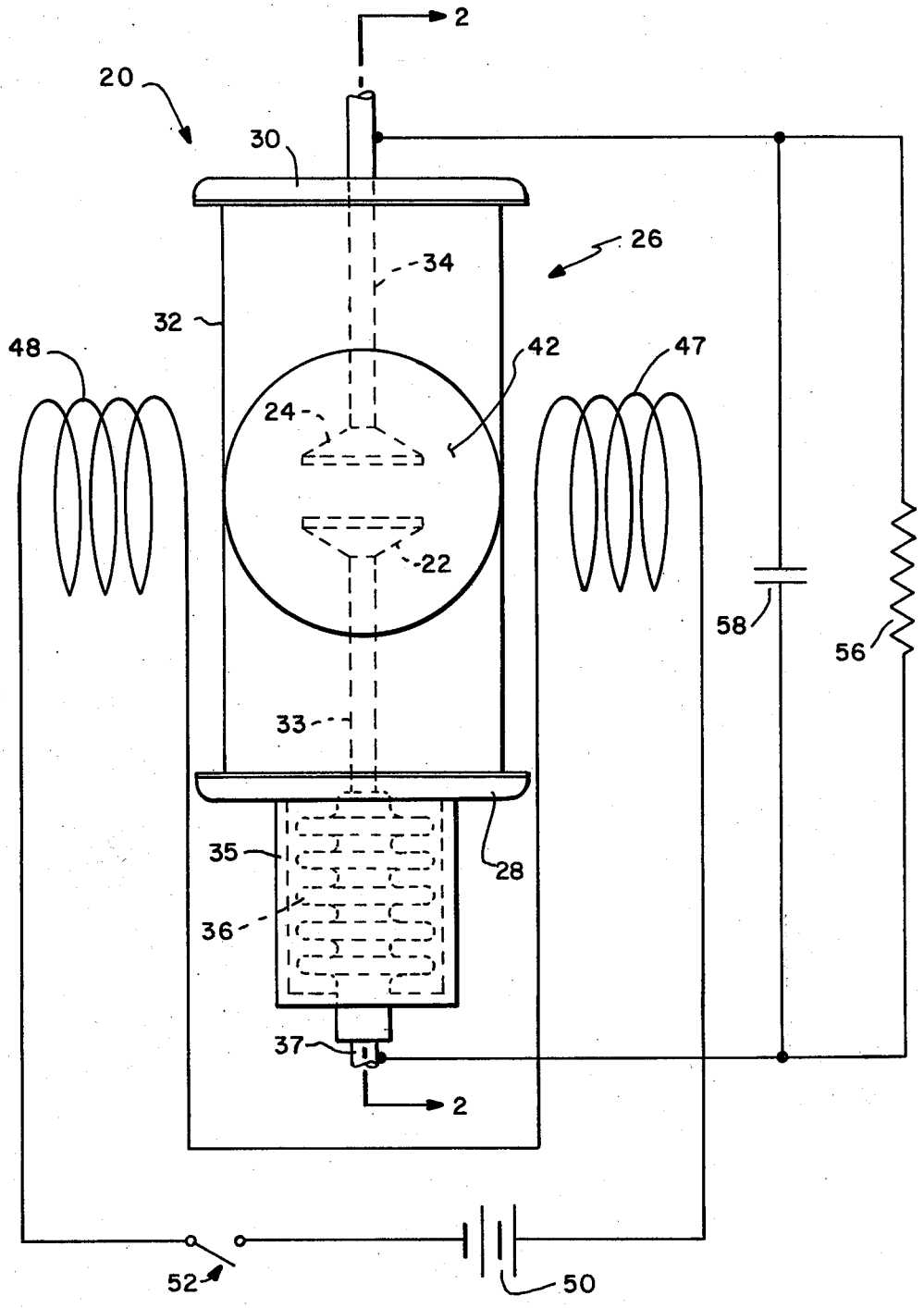
FIG. 1 is a plan view of a current limiting circuit including a current interrupter having an envelope according to the invention.

Referring to FIG. 1, a first embodiment of a current interrupter 20, having electrodes 22 and 24, is connected in parallel with a current limiting circuit. The current interrupter includes an evacuated envelope 26 having spaced end portions 28 and 30 and an intermediate insulating portion 32. Insulating portion 32 is substantially cylindrical in shape. End caps 28 and 30 are suitably sealed to intermediate insulating portion 32 to form a vacuum enclosure. The envelope is evacuated so as to insure a mean-free electron path sufficient to prevent gaseous breakdown in the interelectrode gap. For this purpose the pressure in envelope 26 should be lower than approximately $10^{-4}$ torr.

Electrodes 22 and 24 are each supported by one of the end caps of the envelope. Electrode 22 includes supporting portion 33 and electrode 24 includes supporting portion 34. Both electrodes extend along a first axis which forms the axis of cylindrical insulating portion 32. The first axis also forms an axis of movement along which the electrodes are relatively movable within the envelope. They can be moved into mutual contact to complete an electrical path or separated to induce current interruption. Supporting portion 34 of electrode 24 extends through and is suitably sealed to end cap 30. Supporting portion 33 of electrode 22 is attached to the lower end of bellows 36, as shown in FIG. 1. The upper end of bellows 36 is then suitably sealed to end cap 28, permitting electrode 22 to be movable within the envelope while maintaining a vacuum therein. A cover 35 protects bellows 36. An actuator (not shown) coupled to end 37 of electrode 22 serves to move the electrode into and out of contact with electrode 24.

Figure 2:
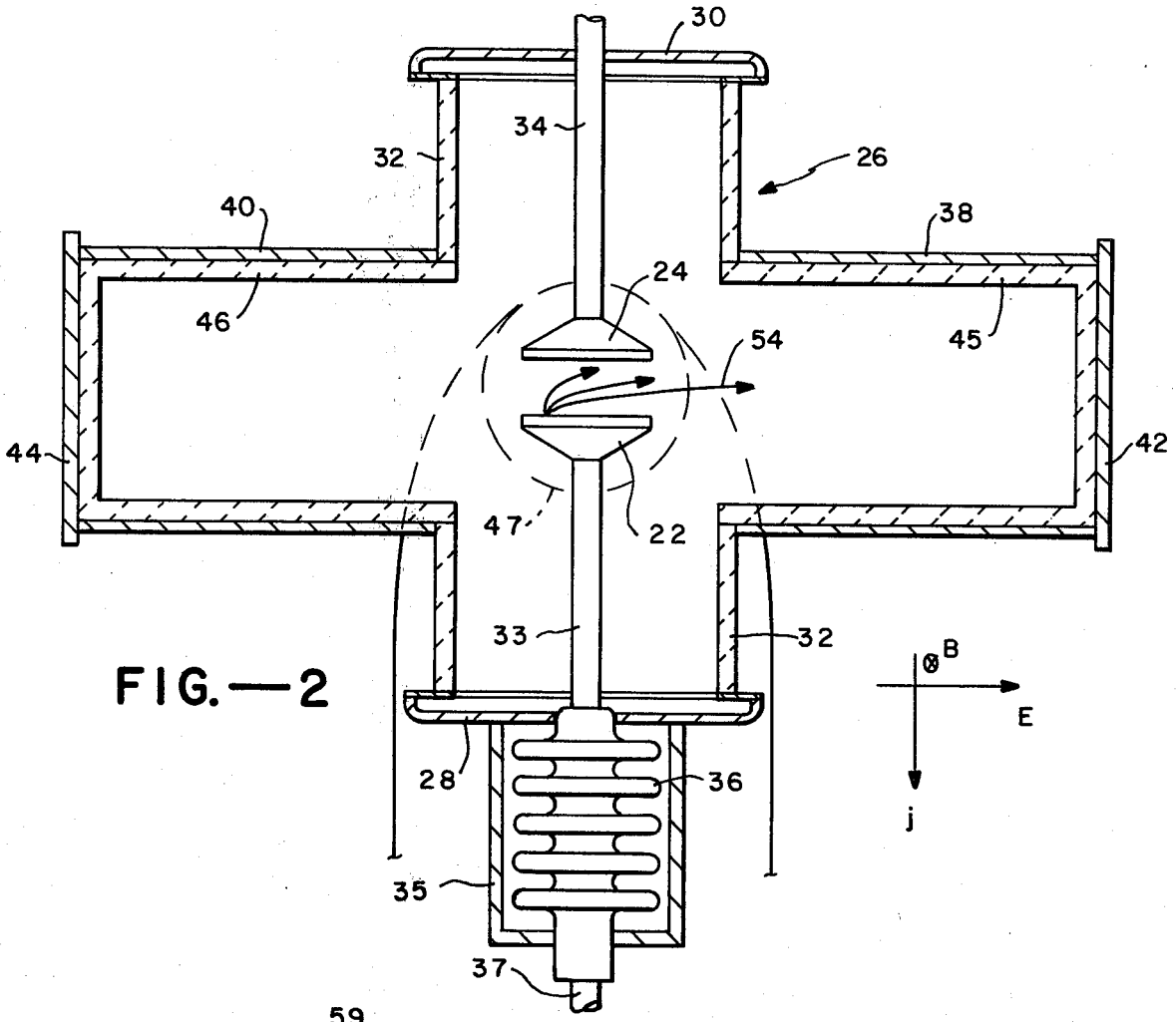
FIG. 2 is a cross-sectional view of the current interrupter of FIG. 1 taken along line 2—2.
Figure 3:
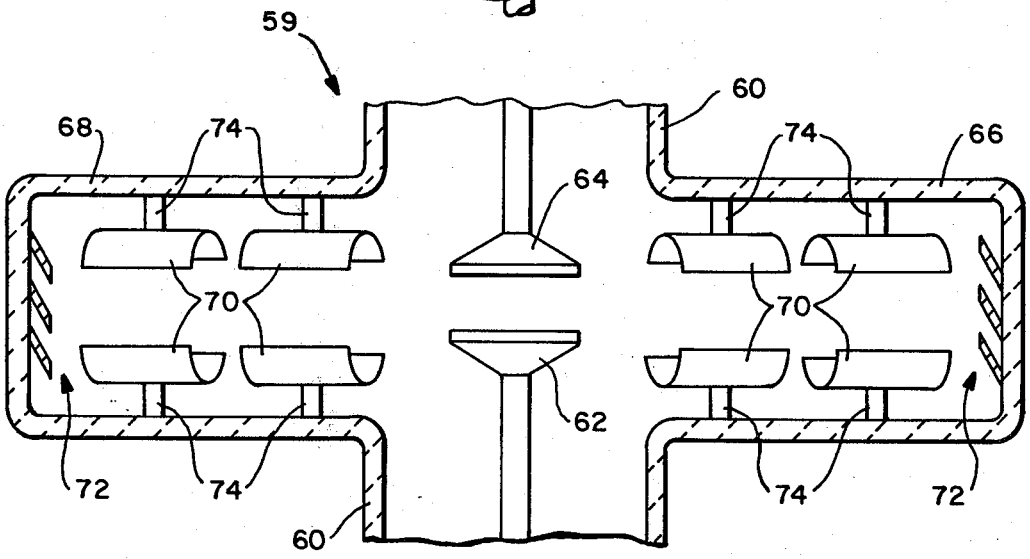
FIG. 3 is a partial cross-sectional view as in FIG. 2 of another embodiment of a vacuum envelope according to the invention.

Intermediate insulating portion 32 is spaced from and surrounds electrodes 22 and 24. As noted above, it is substantially cylindrical in shape having an axis running vertically, as shown in FIGS. 1–3, forming the aforementioned first axis. Insulating portion 32 also includes a pair of protruding tubular portions 38 and 40 extending radially from opposite sides of the cylindrical portion. The tubular protruding portions each form an interior concavity in envelope 26 on opposite sides of insulating portion 32. Both side tubes 38 and 40 extend along a common second axis which is substantially perpendicular to the first axis of portion 32 noted above. In the preferred embodiment, side tubes 38 and 40 are cylindrical and together with cylindrical insulating portion 32 form a cross pattern of intersecting cylinders. The length of side tubes 38 and 40 is optional. Long side tubes provide a greater surface on which to accumulate metallic deposits, but they require a strengthened insulating portion 32 and are more expensive and cumbersome. Short side tubes are less expensive and provide the desired increase in arcing length between the electrodes and the envelope but the interrupter will have a shorter life. In the preferred embodiment, side tubes 38 and 40 provide an overall transverse dimension somewhat greater than the length of envelope 26.

Insulating portion 32 is formed of insulating material such as glass or ceramic so as to prevent shorting between metal end caps 28 and 30. Side tubes 38 and 40 may likewise be formed of insulating material or they may be formed of metal. In the embodiment shown in FIGS. 1 and 2, the side tubes are formed of metal suitably sealed to insulating portion 32 at the intersections thereof. Use of metal for side tubes 38 and 40 provides additional strength. As shown in FIG. 2, tubes 38 and 40 are closed at their respective ends by separate metal caps 42 and 44.

Circuit interrupter 20 also includes means for producing a magnetic field between electrodes 22 and 24 to extinguish the arc. Such means include field coils 47 and 48 disposed outside envelope 26. The coils are positioned on opposite sides of insulating portion 32 aligned perpendicular to side tubes 38 and 40 to provide for minimum coil separation. The coils preferably have an independent power supply 50 and are energized by switch 52. The magnetic field created by coils 47 and 48 has lines of magnetic force which extend transverse to the first axis of cylindrical insulating portion 32 and substantially perpendicular to the second axis along side tubes 38 and 40. Such a transverse field deflects the arc which arises between the electrodes after separation toward the surrounding walls of envelope 26.

Arc extinction is known to occur when the conductive plasma in the interelectrode gap ceases to provide a conductive path between electrodes. The conductive plasma includes electrons and ions of cathode material which are emitted from the cathode and travel to the anode. Under a strong magnetic field the trajectories of the ions and electrons can be bent sufficiently to prevent their reaching the opposite electrode. With a sufficiently strong field, substantially all ions and electrons are prevented from crossing the interelectrode gap and the arc is extinguished. Representative ion emission path from electrode 22 under the influence of a magnetic field are shown at 54 in FIG. 2. A diagrammatic representation in FIG. 2 shows the directions of the various forces involved. The current is flowing in the direction j and the magnetic field B is directly into the page. The current and magnetic field cause an electric field E to arise in the j X B direction as shown. If the transverse field E is sufficiently strong, the ions will be successfully diverted toward the surrounding walls of vacuum envelope 26. Before the arc disappears it is driven to the right as are the metallic acing vapors. Tubular portion 38 is positioned to correspond substantially with the region where the arc is deflected by the magnetic field. The arc and the associated metallic vapors are deflected down side tube 38. In that way the distance between the electrodes and the surrounding insulating portion is increased in the region where the arc is deflected. Arcing between the electrodes and the envelope is thereby inhibited.

In an alternating current system, a fault may be detected with the current flowing in either direction. If at the moment of separation the electrodes have reversed polarity to that in FIG. 2, the field diagram will be changed to shows the current j flowing upward. Electrode 24 would then be the instantaneous cathode and, with the magnetic field still into the page, the transverse electric field E would point to the left. That would tend to drive the arc down the interior concavity within tubular portion 40.

Metal side tubes 38 and 40 are lined with insulating material. The lining is in the form of tubular insulating members 45 and 46 which are placed within tubular portions 38 and 48, respectively. The insulation eliminates conductive paths around the interior concavities. Insulating members 45 and 46 are closed at their ends to cover metal caps 42 and 44, as shown in FIG. 2. An alternative construction could employ insulating members open at both ends to leave the metal caps exposed. When employing relatively long side tubes, the ends need not be protected with insulation since arcing between the electrodes by way of the distant metal caps is exceedingly unlikely.

The first embodiment of a current interrupter described above is adapted to be placed on a power line in parallel with a current-suppressive circuit which will rapidly reduce excessive current flow. A representative example of such a circuit comprises resistor 56 in parallel with capacitor 58. When the current is diverted from the interrupter into this parallel circuit the resistor and capacitor provide an impedance which maintains the current flowing therethrough within safe limits.

In operation, current interrupter 20 is placed on a power distribution line with electrodes 22 and 24 in mutual contact. Line current flows freely between the electrodes and no current is diverted into the parallel current-suppressive load. When a line fault occurs, by way of a substantial current path to ground for example, the current passing through interrupter 20 increases rapidly. Apparatus (not shown) continuously monitors line current to detect rapid rises in current flow indicating a fault. When a fault is detected, such apparatus sends a signal to the actuator for moving electrode 22 described above. The electrodes are rapidly separated causing arcing between the electrodes. Field coils 47 and 48 are energized by closing switch 52 causing a strong magnetic field to arise between the electrodes driving the arc down one of the side tubes 38 and 40 as described above. When the arc is extinguished, the fault current is diverted into the parallel current-suppressive impedance which maintains the line current within safe limits.

Referring to FIG. 3, an alternative embodiment of a current interrupter is shown having a vacuum envelope according to the invention. In this embodiment the envelope 59 is formed with end caps such as those in the first embodiment suitably sealed to intermediate insulating portion 60. The envelope is evacuated as described above. Electrodes 62 and 64 are relatively movable along a first axis of portion 60 extending vertically through the electrodes as shown in FIG. 3. Actuating means and the external circuitry including the means for producing a transverse magnetic field are the same as for the first embodiment.

Intermediate insulating portion 60 is formed of a suitable insulating material such as ceramic or glass. The main body of insulating portion 60 is substantially cylindrical in shape. Protruding tubular portions 66 and 68 are integral with the main body. They project from opposite sides of portion 60 along a second axis transverse to the first axis of portion 60. As in the first embodiment, side tubes 66 and 68 are preferably cylindrical. The one-piece construction is less expensive than using separate metal side tubes lined with insulation, but it has been found to be more fragile.

The surfaces of the interior concavities within side tubes 66 and 68 include baffle members 70 and 72. Baffles 70 are in the form of trough-shaped tubular segments arrayed in opposing pairs suspended from the interior of the side tubes. The baffles 70 provide a segmented tubular path along the aforementioned second axis of the side tubes. Baffles 70 are formed of either metal or an insulating material and are supported by members 74 likewise formed of either metal or insulating material. The spacing between upper and lower baffle members 70 is preferably comparable with the interelectrode gap when electrodes 62 and 64 are separated, as shown in FIG. 3.

The ends of side tubes 66 and 68 are protected by baffles 72 which project angularly into the concavities. Baffles 72 may be formed of metal or insulating material attached to the walls of the concavities. Baffles 72 may also be formed by convoluting the interior of the insulating portion at the ends of the side tubes into angular projections.

Operation of the interrupter shown in FIG. 3 is the same as that in the first embodiment. Upon application of the transverse magnetic field the interelectrode arc is driven down one of the side tubes. Baffles 70 and 72 are adapted to collect the deposits of metallic arcing vapors and thereby to prevent formation of continuous current paths within the side tubes. Without such protection the interior surfaces of the side tubes will tend to accumulate continuous metallic deposits. After repeated interruptions these deposits can coat the interior concavities. This particularly is a problem when the metallic coating approaches the entrance to the side tubes because it will tend to encourage arcing from one electrode to the insulating wall and then back to the other electrode. It is the purpose of baffles 70 and 72 to break up any current paths along the envelope wall. For this purpose baffles 70 are of greater importance than baffles 72 in that current paths are less likely to be formed and cause fewer problems along the most distant wall portion of the envelope.

Other embodiments of current interrupters are possible within the scope of the invention. The insulated lining of the metal side tubes in the first embodiment could be protected by baffles of the type shown in FIG. 3. Likewise, the interrupter of FIG. 3 having a one-piece insulating portion could be employed without baffles. For direct-current applications an interrupter according to the invention would have only a single protruding side tube with an interior concavity in the region where the arc is deflected by the transverse magnetic field. Finally, although it is preferable for the protruding side portions to be tubular in shape, other shapes could be employed. Protrusions in the form of hemispheres, for example, would provide some additional arcing distance between the electrodes and the surrounding envelope wall and thus achieve the improved performance desired.

There has been provided a current interrupter of the vacuum type employing magnetic arc suppression which has improved performance. Space between the electrodes and the surrounding envelope walls is increased in the direction of arc deflection without the need for increasing the overall diameter of the envelope. In that way the magnetic field coils can be positioned in relatively close mutual proximity.

What is claimed is:

1. A current interrupter for rapidly interrupting currents associated with power line faults comprising: an evacuated envelope having spaced end portions and an intermediate insulating portion sealed to said end portions, a pair of electrode members within said envelope each supported by one of said end portions of said envelope, said electrode members being relatively movable within said envelope into mutual contact to complete an electrical path and also being separable to induce current interruption wherein an arc arises between said electrode members after separation carrying current generally along a current path j, said insulating portion of said envelope being spaced from and surrounding said electrode members, and means for producing a magnetic field between said electrode members having lines of magnetic force oriented along a direction B which is perpendicular to said current path j to deflect an arc current flowing along current path j in the j X B direction, said insulating portion including a pair of protruding portions which extend outwardly from said electrode member along direction j X B to provide a pair of interior concavities in said envelope positioned to correspond substantially with direction j X B for the various polarities of j and B.

2. A current interrupter as in claim 1 in which said interior concavity includes baffle members on the interior surface thereof.

3. A current interrupter for rapidly interrupting currents associated with power line faults comprising: an evacuated envelope including a substantially cylindrical insulating portion having a first axis, a pair of electrode members supported for relative movement along said first axis within said envelope, said electrode members being movable into mutual contact to complete an electrical path and also being separable, said envelope further including a substantially cylindrical side tube extending outwardly from said insulating portion, said side tube having a second axis radially perpendicular to said first axis, and field coil means for producing a magnetic field between said electrode members when separated, said field coil means including a pair of coils positioned exterior of said envelope on opposite sides of said insulating portion aligned to produce lines of magnetic force transverse to said first axis and perpendicular to said second axis whereby said side tube forms an interior concavity in said envelope where the arc is deflected by the magnetic field.

4. A current interrupter as in claim 3 in which two said side tubes are formed on opposite sides of said insulating portion.

5. A current interrupter as in claim 3 in which said side tube is formed of metal.

6. A current interrupter as in claim 5 in which said interior concavity formed by said side tube is lined with insulating material.

7. A current interrupter as in claim 3 in which the interior surface of said interior concavity includes baffle members.

8. An alternating current interrupter for rapidly interrupting currents associated with power line faults comprising: an evacuated envelope having spaced end portions and a substantially cylindrical intermediate insulating portion sealed to said end portions, a pair of electrode members within said envelope each supported by one of said end portions of said envelope and extending along a first axis which is the axis of said substantially cylindrical insulating portion, said electrode members being relatively movable along said first axis within said envelope into mutual contact to complete an electrical path and also being separable to induce current interruption thereby causing arcing between said electrode members along a current path j, said insulating portion of said envelope being spaced from and surrounding said electrode members and including two tubular protruding portions each forming an interior concavity in the envelope on opposite sides of said insulating portion, said protruding portions both extending along a common second axis which is substantially perpendicular to said first axis, means for producing a magnetic field between said electrode members having lines of magnetic force oriented along a direction B substantially perpendicular to said first and second axes to deflect the arc from between said electrode in the j X B direction toward said interior concavities formed by said protruding portions and extinguish the arc.

9. A current interrupter as in claim 8 in which said two interior concavities in the envelope formed by said two tubular protruding portions each include baffle members on the interior surface thereof.

10. A current interrupter as in claim 8 in which said two tubular protruding portions are formed of metal.

11. A current interrupter as in claim 10 in which said interior concavities formed by said two tubular protruding portions are lined with insulating material.

12. A current interrupter for rapidly interrupting currents associated with power line faults comprising: an evacuated envelope, a pair of electrode members supported in said envelope for relative movement into mutual contact to complete an electrical path, said electrode members being separable to define an arc gap across which are arc arises carrying current generally along a current path j, means for producing a magnetic field in said arc gap having lines of magnetic force oriented along a direction B which is perpendicular to said current path j to deflect an arc current flowing along current path j in the j X B direction, said envelope including a portion surrounding said electrode members having a generally cylindrical shape which includes a pair of protruding side tubes aligned with direction j X B for the various polarities of j and B to provide interior concavities in said envelope along the j X B direction.

13. A current interrupter as in claim 12 in which said interior concavities include baffle members on the interior surface thereof.

14. A current interrupter as in claim 12 in which said means for producing a magnetic field includes a pair of field coils positioned on opposite sides of said envelope aligned to produce lines of magnetic force along direction B.

15. A current interrupter for rapidly interrupting currents associated with power line faults comprising: an evacuated envelope, a pair of electrode members supported in said envelope for relative movement into mutual contact to complete an electrical path, said electrode members being separable to define an arc gap across which an arc arises carrying current between said electrode members, means for producing a magnetic field in said arc gap having lines of magnetic force which perpendicularly cross the current path of an arc in said arc gap whereby said magnetic field will deflect the current path of an arc in said arc gap in a direction perpendicular to both the current path of an arc in said arc gap and said lines of magnetic force, said envelope including a side tube protruding outwardly from said arc gap to provide an interior concavity in said envelope in said direction perpendicular to both the current path of an arc in said arc gap and said lines of magnetic force whereby said envelope is spaced further from said arc gap in said last named direction than in the direction of said lines of magnetic force.

16. A current interrupter as in claim 14 in which said interior concavities include baffle members on the interior surface thereof.

17. A current interrupter as in claim 15 in which said means for producing a magnetic field includes a pair of field coils positioned on opposite sides of said envelope.

* * * * *